United States Patent [19]

Beldam et al.

[11] Patent Number: 4,846,268

[45] Date of Patent: Jul. 11, 1989

[54] HEAT EXCHANGER WITH INDIVIDUAL TWINPLATE HEADERS

[75] Inventors: Richard P. Beldam, Etobicoke; Walter Himsl, Mississauga, both of Canada

[73] Assignee: Thermag Industries Inc., Mississauga, Canada

[21] Appl. No.: 143,117

[22] Filed: Jan. 12, 1988

[51] Int. Cl.[4] ..... F28F 9/16; F28D 1/06

[52] U.S. Cl. ..... 165/153; 165/175; 165/173; 29/157.4

[58] Field of Search ..... 165/153, 173, 175, 166; 29/157.4

[56] References Cited

U.S. PATENT DOCUMENTS

| | | | |
|---|---|---|---|
| 3,207,216 | 9/1965 | Donaldson | 165/175 |
| 3,670,812 | 6/1972 | Bemrose | 165/175 |
| 4,011,905 | 3/1977 | Millard | 165/175 |
| 4,441,547 | 4/1984 | Argyle | 165/153 |
| 4,470,455 | 9/1984 | Sacca | 165/153 |

FOREIGN PATENT DOCUMENTS

| | | | |
|---|---|---|---|
| 2306999 | 8/1973 | Fed. Rep. of Germany | 165/175 |
| 1039173 | 10/1953 | France | 165/175 |
| 1393943 | 2/1965 | France | 165/175 |
| 217697 | 9/1986 | Japan | 165/153 |

*Primary Examiner*—Albert W. Davis, Jr.

*Attorney, Agent, or Firm*—Cushman, Darby & Cushman

[57] ABSTRACT

A heat exchanger comprising a multiplicity of longitudinally extending flattened tube structures disposed in a longitudinal coextensive array with fin structures bonded in abutting relation between adjacent pairs of tube structures. First and second header assemblies are connected with first and second end portions respectively of each tube structure and provide a fluid inlet for receiving a first fluid for passage through the tube structures during the passage of a second fluid through the fin structures. The first fluid passes from the second header assembly through a fluid outlet. Each header assembly is formed of a series of interconnected header structures, each of which comprises a pair of sheet metal plates formed to provide first marginal edge portions sealingly fixed in abutting relation with the exterior periphery of the associated tube structure end portion and wall portions spaced in a direction perpendicular to the longitudinal direction of extent of the tube structures having aligned openings therein. The remainder of the marginal edge portions of the plates are sealingly fixed in abutting engagement which together with the first marginal edge portions surround the openings and define with the spaced portions an enclosed first fluid containing volume communicating the interior of the associated tube structure end portion with the openings. Each spaced portion of each pair of sheet metal plates is sealingly fixed to a spaced portion of an adjacent pair of sheet metal plates along peripheries defining the openings therein.

12 Claims, 3 Drawing Sheets

HEAT EXCHANGER WITH INDIVIDUAL TWINPLATE HEADERS

This invention relates to heat exchangers and, more particularly, to heat exchangers of the radiator type such as are embodied in the water cooling systems of automotive engines.

Conventional radiator technology utilizes a multiplicity of longitudinally extending flattened tube structures and a multiplicity of longitudinally extending accordion fin structures. The tube structures are disposed in a longitudinally coextensive array with the fin structures disposed in abutting relation between adjacent pairs of tube structures. The tube structures have a longitudinal extent greater than the fin structures and are arranged so that opposite first and second end portions extend longitudinally outwardly in opposite directions from the adjacent ends of the fin structures. These opposite ends are then engaged within openings formed in a header shell. This assembly is then sealed together as for example by brazing. Each header is completed by engaging a mating header tank part with the header shell part and crimping the latter over a lip of the tank part and a seal element.

In addition to this conventional type construction, there has also been developed a paired plate technology. See, for example, U.S. Pat. Nos. 3,207,216, 4,011,905, and 4,470,455. See also U.S. Pat. No. 4,441,547 which discloses both conventional and paired plate radiators. Paired plate technology involves the fabrication of pairs of complimentary plates which when properly united provide not only a tube structure but part of the header structure as well. Using paired plate technology, a radiator is assembled simply by stacking a number of cooperating pairs of plates one upon another and capping off the bottom and top of the stack. As before, the assembly is then sealed together, as by brazing.

In recent years particularly with the increased use of intercoolers with diesel engines for trucks, the specialized truck manufacturing industry has been faced with the need to provide radiators of a special capacity and size in numbers far less than the numbers required for automotive use. The increased need to make the radiator fit the truck rather than the truck to fit the radiator taken with the decreased volume when compared with automotive radiator volumes results in increased costs due to tooling costs. Even in automotive usage, the trend toward aerodynamic vehicles with low front end profiles requires the majority of radiators to be of the cross-flow type, with tanks on the sides and coolant flow through the tubes in the horizontal plane. Radiators of different width thus require only changes in tube, fin, and side member length. Change of height, however, requires different tooling for both tanks and headers. As the tank and header tooling is the most expensive portion of the tooling for a radiator, usage of various different radiator heights for special or lower volume applications can be severely restricted by cost of tooling.

A major deterrent to the use of plate technology is the extremely high tooling costs due to the large size of the plates utilized. The economics are such that plate technology requires large volume in order to be cost effective. Plate technology allows height changes to be readily accommodated but a width change requires a new set of forming tools. Presently available technology due to design limitations and tooling costs cannot provide the low volume radiator needs with the same cost effectiveness as the high volume needs are satisfied.

An object of the present invention is to provide radiator technology which can meet the lower volume needs in a cost effective manner. In accordance with the principles of the present invention, this objective is obtained by providing a radiator comprising a multiplicity of longitudinally extending flatten tube structures and a multiplicity of longitudinally extending accordian fin structures. The tube structures are disposed in a longitudinally coextensive array with the fin structures bonded in abutting relation between adjacent pairs of tube structures. The tube structures have a longitudinal extent greater than the fin structures and are arranged so that opposite first and second end portions extend longitudinally outwardly in opposite directions from the adjacent ends of the fin structures. The radiator also includes first and second header assemblies connected with the first and second end portions respectively of each tube structure and providing a fluid inlet for receiving a first fluid for passage through the tube structures during the passage of a second fluid through the fin structures and a fluid outlet for delivering the first fluid after it has passed through the tube structures. Each header assembly is formed of a series of interconnected header structures. The series of header structures of each assembly include an individual header structure associated with each tube structure end portion comprising a pair of sheet metal plates formed to provide first marginal edge portions sealingly fixed in abutting relation with the exterior periphery of the associated tube structure end portion. The fluid inlet and the fluid outlet means are associated with certain of the individual header structures. The remainder of the individual header structures are constructed such that the pair of sheet metal plates comprising the same are also formed to provide wall portions spaced in a direction perpendicular to the longitudinal direction of extent of the tube structures and having aligned openings therein and remaining second marginal edge portions sealingly fixed in abutting engagement which together with the first marginal edge portions surround the openings and define with the spaced portions an enclosed first fluid containing volume communicating the interior of the associated tube structure end portion with the openings. Each spaced portion of each pair of sheet metal plates is sealingly fixed to a spaced portion of an adjacent pair of sheet metal plates along peripheries defining the openings therein.

By this combination, the present invention retains the combined dimensional variation advantages of both conventional end plate technology while eliminating in large measure the combined tooling cost disadvantages thereof. Thus, both width and height variation is readily possible without tooling changes while the cost effectiveness of plate technology is retained in the header structure. It is recognized that U.S. Pat. No. 3,670,812 discloses a radiator having a paired plate construction in FIG. 1 and a variation of that radiator in FIGS. 2–7. The variation includes the provision of modified paired plates in which each end is cut-off in a concave 180° arcuate configuration so as to cooperatively connect with a built-up header assembly formed by a stack of identical metal castings. This arrangement is essentially different from that of the present invention and would not afford the same cost effectiveness as that attributable to the present invention.

Another object of the present invention is the provision of a heat exchanger of the type described which is simple in construction, effective in operation and economical to manufacture.

These and other objects will become more apparent during the course of the following detailed description and appended claims.

The invention may best be understood with reference to the accompanying drawings wherein an illustrative embodiment is shown.

IN THE DRAWINGS

Figures 1A, 1B:
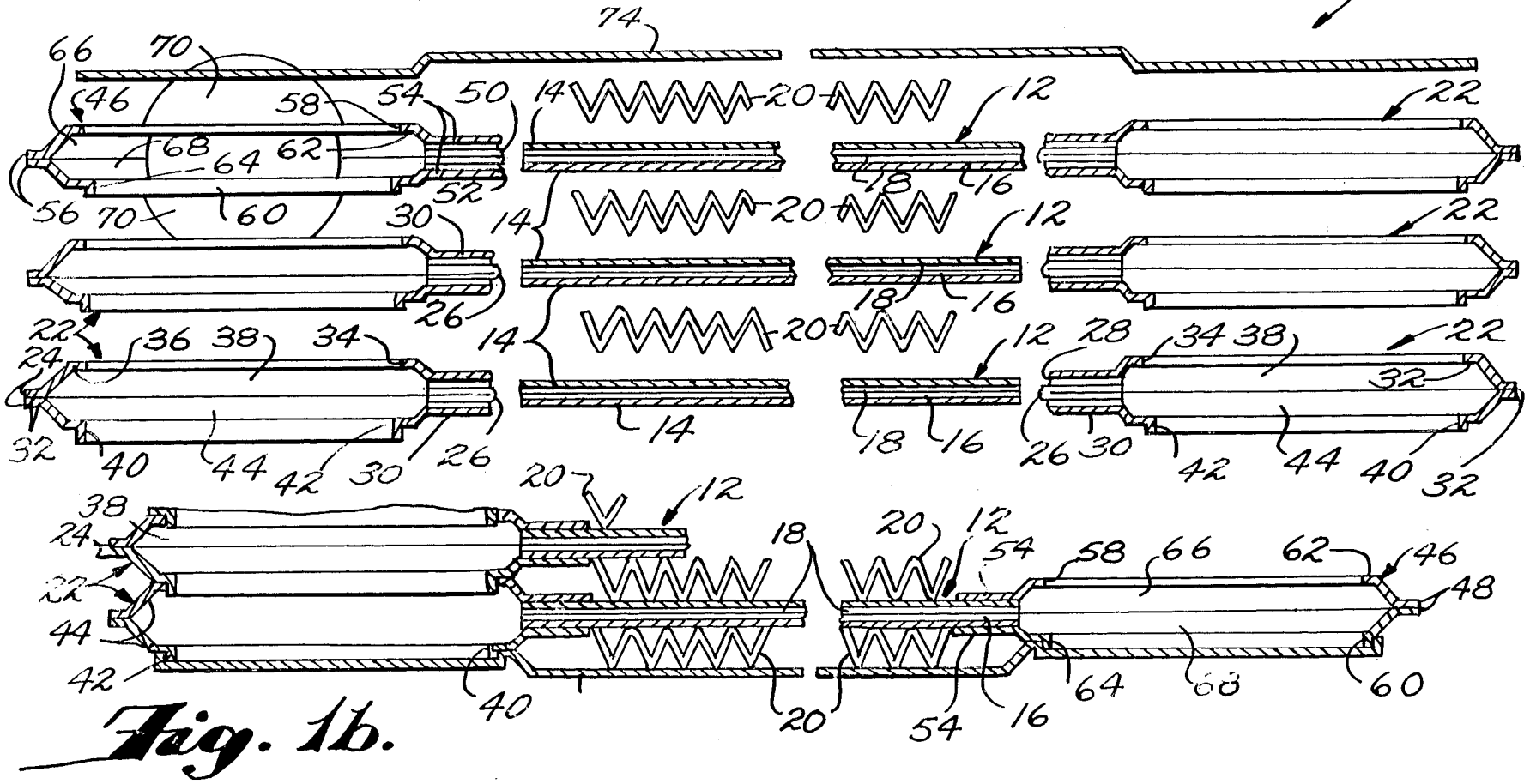
FIG. 1A is a vertical sectional view of an upper portion of a heat exchanger embodying the principles of the present invention showing the components in exploded relationship.
FIG. 1B is a vertical sectional view of a lower portion of the heat exchanger showing the components in assembled relationship.
Figure 2:
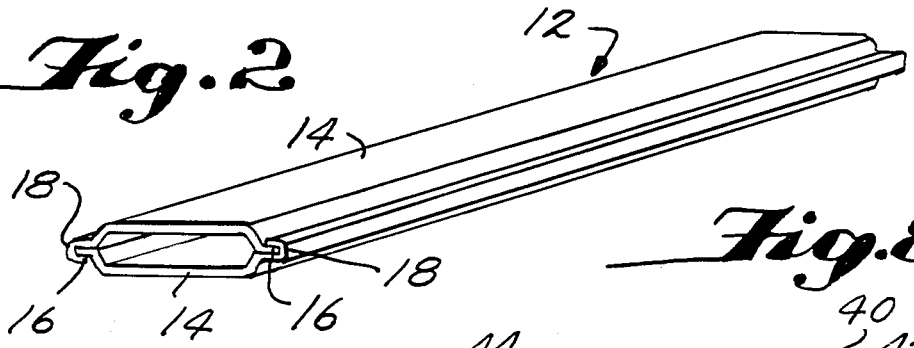
FIG. 2 is a perspective view of a tube structure forming a part of the heat exchanger.
Figure 8:
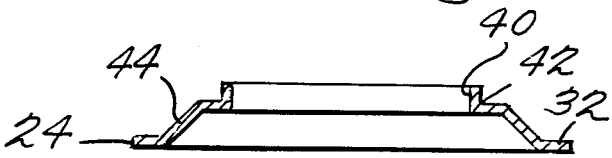
FIG. 8 is a sectional view taken along the line 8—8 of FIG. 3.

Referring now more particularly to the drawings, there is shown in FIG. 1 an exploded view of the components forming a heat exchanger, generally indicated at 10, embodying the principles of the present invention. As shown, the heat exchanger includes a multiplicity of longitudinally extending flattened tube structures, generally indicated at 12. As best shown in FIG. 2, each tube structure 12 is formed of a pair of metal strips 14 which may be made of aluminum alloy, or other metal suitable for brazing in the manner hereinafter specified. As shown, each of the metal strips 14 is formed into an identical cross-sectional configuration. To this end, one marginal edge of each strip is bent transversely and then extended outwardly in a parallel relation to form a tongue 16. The opposite marginal edge portion is bent laterally and then outwardly and around into a U-shaped configuration to provide a groove 18. The two strips 14 are interengaged to provide a tube structure 12 by inserting the tongue 16 of one strip 14 into the groove 18 of the other strip 14 while the groove of the one strip receives the tongue of the other strip. It will be understood that the flattened tube structures 12 may assume other configurations, as, for example, conventional welded flattened tube structures, extruded flattened tube structures, and other two-piece flattened tube structures, such as, for example, two strips in which tongues are provided at both ends along both marginal portions and the tongues are butt welded together or a configuration in which one strip is provided with grooves on both marginal edges and the other strip is simply a straight strip with the marginal edges fitting in the two grooves.

Referring again to FIG. 1, it will be noted that the heat exchanger 10 also includes a multiplicity of longitudinally extending accordian fin structures 20. As shown, each fin structure 20 is formed into a V-shaped accordian configuration, although, it will be understood that other types of accordian configurations can be utilized, as, for, example, the configuration disclosed in U.S. Pat. No. 3,670,812. Each fin structure 20 preferably formed from the same metallic material as the tube structures 12.

Figure 3:
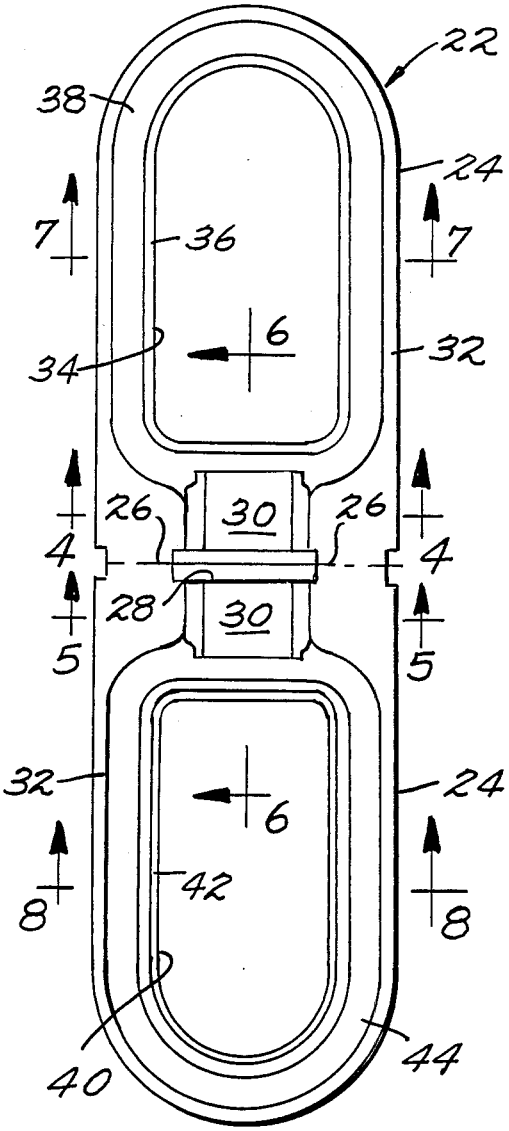
FIG. 3 is a top plan view of a blank providing a pair of sheet metal plates configured to form an individual header structure forming a part of the heat exchanger shown in FIG. 1.
Figure 7:
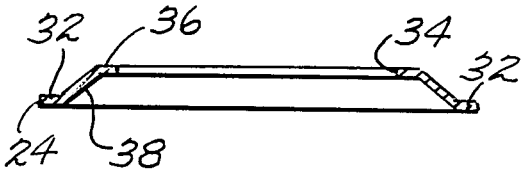
FIG. 7 is a sectional view taken along the line 7—7 of FIG. 3.
Figure 4:
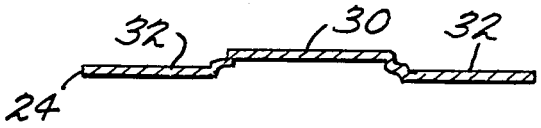
FIG. 4 is a sectional view taken along the line 4—4 of FIG. 3.
Figure 5:
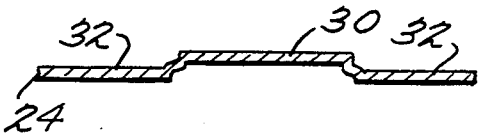
FIG. 5 is a sectional view taken along the line 5—5 of FIG. 3.
Figure 6:
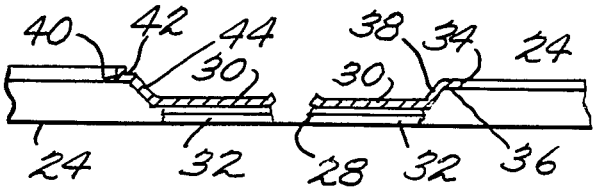
FIG. 6 is a sectional view taken along the line 6—6 of FIG. 3.

Again referring to FIG. 1, it will be noted that the heat exchanger 10 also includes a multiplicity of individual header structures, generally indicated at 22. FIG. 3 illustrates an individual header structure 22 in the form of a blank configured to define a pair of sheet metal plates 24 interconnected along a common end fold line 26. The sheet metal plates ar formed of any metal suitable for brazing in the manner hereinafter specified. The fold line 26 divides the blank into two similarly shaped sheet metal plates 24 which, when the blank is folded along the fold line through 180°, cooperate together to form an individual header structure 22. As shown, a central rectangularly shaped opening 28 is formed in the central portion of the blank along the fold line 26. Extending from the blank opening 28 in each direction is a shallow U-shaped wall portion 30 which conforms in cross-sectional configuration to one-half of the exterior cross-sectional configuration of an associated tube structure 12. This configuration is illustrated in FIGS. 4, 5 and 6. As shown, the wall portions 30 are positioned on adjacent margins of the two plates 24 of the blank defining the individual header structure 22. The remaining margins of both plates are defined by flat wall portions 32 adapted to abut one another when the blank is folded along the portions of the fold line 26 on opposite sides of the opening 28. In this way, the U-shaped wall portions 30 define together a sleeve construction of a shape to receive an adjacent end of a tube structure 12 and to generally conform to the interior periphery thereof.

One of the plates 24 is formed with a relatively large central opening 34 which is defined by a narrow flat marginal portion 36 disposed in parallel relation with the associated exterior flat marginal wall portion 32. An annular wall portion 38 extends between the narrow flat interior marginal wall portion 36 and the associated exterior marginal wall portion 32 and U-shaped wall portion 30. The other plate 24 is formed with a slightly smaller matchingly configured opening 40 which is defined by the upright leg of an L-shaped marginal wall portion 42, the other leg of which is disposed in parallel relation with the associated exterior flat marginal wall portion 32. As before, an annular wall portion 44 extends between the marginal wall portion 42 and the associated exterior marginal wall portion 32 and U-shaped wall portion 30. It can be seen from FIG. 1, that when the two plates 24 of the blank shown in FIG. 3 are folded along the fold line portions 26 so that the exterior marginal wall portions 32 are brought into abutting engagement, the interior marginal wall portions 36 and 42 are spaced apart in a direction perpendicular to the longitudinal extent of the sleeve defined by the wall portions 30. Moreover, the openings 34 and 40 defined by the wall portions 36 and 42 are disposed in alignment. The annular wall portions 38 and 44 define a first fluid containing volume communicating the sleeve defined by the wall portions 30 with the openings 34 and 40.

Figure 10:
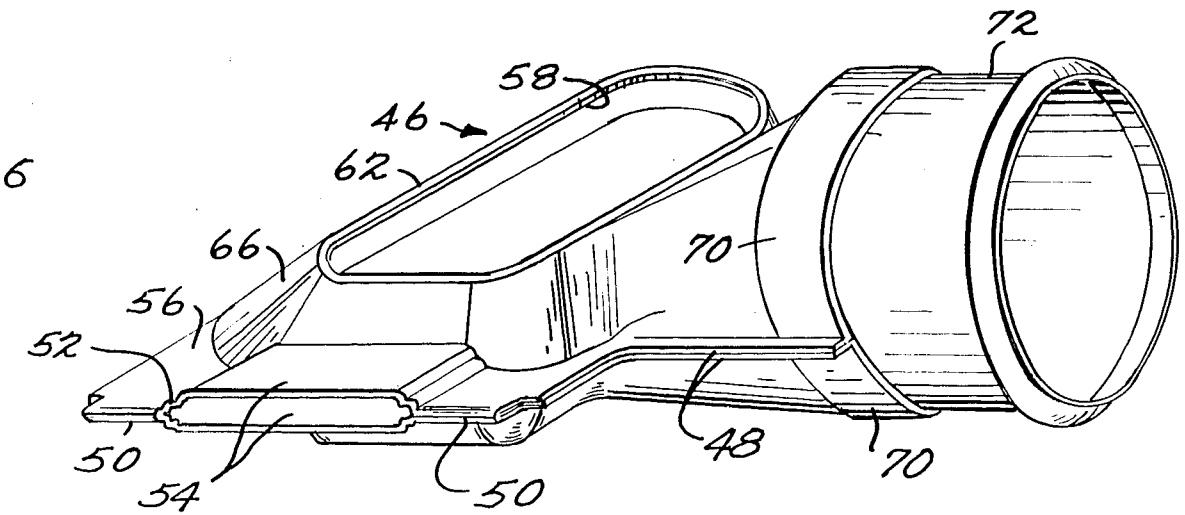
FIG. 10 is a perspective view of the formed individual header structure shown in FIG. 9.
Figure 9:
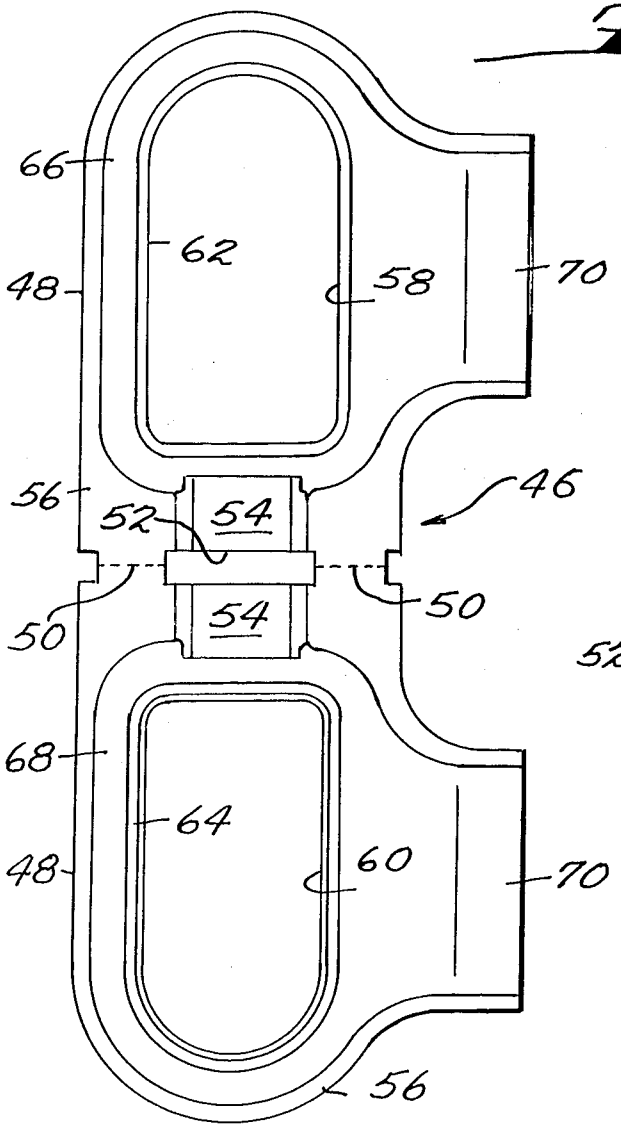
FIG. 9 is a view similar to FIG. 3 illustrating a blank defining a pair of sheet metal plates configured to form an individual header structure providing an inlet.

Referring now more particularly to FIGS. 9 and 10, there is shown in FIG. 9 a blank forming an individual header structure 46 which is modified to provide an inlet. The blank except for the portion defining the inlet follows the construction of the blank for the header structure 22 previously described. Thus, the blank of the header structure 46 provides a pair of sheet metal plates 48 interconnected along a common end fold line 50, a central rectangular opening 52, a pair of U-shaped wall portions 54, exterior flat marginal wall portions 56, openings 58 and 60 defined by narrow marginal wall portions 62 and 64 respectively and annular wall portions 66 and 68 respectively. The inlet is provided by forming a semicylindrical wall portion 70 in one side edge section of each exterior flat marginal wall portion 56. The two semicylindrical wall portions 70 form a cylindrical sleeve when the blank is folded along fold line portions 50 so as to bring the flat marginal wall portions 56 into abutting engagement. As shown, a connector sleeve 72 is fixed within the sleeve provided by the wall portions 70.

In constructing the heat exchanger 10, two header structures 46 are utilized one of which provides the inlet, as described above, and the other of which provides an outlet for the flow of a first fluid through the heat exchanger. Finally, a top plate 74 and a bottom plate 76 serve to cap off and complete the heat exchanger 10 except for accessories and the like which are well known.

FIG. 1 illustrates the manner in which the component parts are assembled to form the heat exchanger 10. As shown, the desired number of tube structures 12 are disposed in a longitudinally coextensive array with the fin structures 20 disposed between adjacent pairs of tube structures. The tube structures 12 have a longitudinal extent greater than the fin structures 20 and are arranged so that opposite first and second end portions extend longitudinally outwardly in opposite directions from the adjacent ends of the fin structures 20. At the first end portions of the tube structures, an inlet providing header structure 46 and an appropriate number of header structures 22 are assembled together and with the first end portions of the tube structures 12. The assembly of each header structure with the first end portion of the associated tube structure constitutes a simple insertion of the tube structure end portion into the sleeve defined by the wall portions 30 or 54 of the associated header structure. The assembly of the header structures together constitutes a simple insertion of the leg of the interior marginal portion 42 or 64 defining the opening 40 or 60 within the opening 34 of the adjacent header structure 22. The header structures thus assembled with the first ends of the tube structures 12 constitute a first header assembly. A second header assembly comprising a comparable number of individual header structures 22 and an outlet header structure 46 are similarly assembled together and with the second end portions of the tube structures 12.

In addition to the above, plates 74 is mounted in abutting relation with the exposed uppermost inlet header assembly 46 and associated header assembly 22 and the plate 76 is mounted in abutting relation with the lowermost outlet header structure 46 and associated header structure 22. The entire assembly is then brazed in accordance with conventional procedures. Generally, there are two types of brazing utilized, either one with flux or one without flux. Fluxless brazing is generally done in a vacuum using a magnesium-rich clad alloy, the magnesium acting as a getter for oxygen. Flux brazing typically uses chloride or fluoride based fluxes in either an air or an inert gas atmosphere furnace. The brazing serves to fixedly secure all of the components in their assembled relation and to establish a seal which provides a watertight passage for the flow of a first fluid, as, for example, water through the inlet and the header volumes of the first header assembly and then through the interior of the tube structures 12 to the volumes in the second header assembly after which the fluid passes through the outlet. The second fluid flows through the spaces defined by the fin structures between the tube structures.

It will be understood that the header components are subject to suitable modification from the preferred configuration described. For example, under certain circumstances it may be desirable to form the fin structures in the wall of the tube structure as is contemplated in some paired plate-type heat exchangers. It has already been indicated that the tube structure may assume a variety of different configurations. Similarly, the header structures 22 and 46 may be formed of separate plates or of a single blank defining plates which are hinged together along a common side edge or along the free end edges shown in the drawing, in which case the end edges would be more squared off.

It can be seen that the particular components utilized in the heat exchanger provide the manufacturer with a simple manner of varying the number of component parts to achieve variation in the vertical dimension of the finished heat exchanger. Horizontal variation in the finished heat exchanger is accomplished simply by varying the length of the tube structures 12 and fin structures 20. Thus, it becomes possible to satisfy a wide range of design requirements without change in tooling. Moreover, the sheet metal formation of the components and their assembly makes the finished heat exchanger cost effective.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A heat exchanger suitable for automotive vehicle use comprising a multiplicity of longitudinally extending flattened tube structures, a multiplicity of longitudinally extending accordion fin structures, said tube structures being disposed in a longitudinally coextensive array with said fin structures bonded by brazing in abutting relation between adjacent pairs of tube structures, first and second header assemblies connected with the first and second end portions respectively of each tube structure and providing fluid inlet means for receiving first fluid means for passage through said tube structures during the passage of second fluid means through said fin structures and fluid outlet means for delivering the first fluid means after it has passed through said tube structures, each header assembly being formed of a series of interconnected header structures, the series of header structures of each assembly including an individual header structure associated with each tube structure end portion comprising a pair of sheet metal plates devoid of copper formed to provide first marginal edge portions sealingly fixed in abutting relation with the exterior periphery of the associate tube structure end portion, said fluid inlet means an said fluid outlet means being associated with certain of said individual header structures, the remainder of said individual header structures being constructed such that the pair of sheet metal plates comprising the same are also formed to provide wall portions spaced in a direction perpendicular to the longitudinal direction of extent of said tube structures and having aligned openings therein and remaining second marginal edge portions sealingly fixed by brazing in abutting engagement which together with said first marginal edge portions surround said openings and define with said spaced portions an enclosed first fluid means containing volume communicating the interior of the associated tube structure end portion with said openings, each spaced portion of each pair of sheet metal plates being sealingly fixed by brazing to a spaced portion of an adjacent pair of sheet metal plates along peripheries defining the openings therein whereby the heat exchanger can be inexpensively fitted to the specific automotive use.

2. A heat exchanger as defined in claim 1 wherein each of said tube structures is formed of a pair of metal strips devoid of copper fixedly secured by welding along opposite marginal edge portions.

3. A heat exchanger as defined in claim 2 wherein each metal strip includes one marginal edge portion shaped to define a tongue and an opposite marginal edge portion shaped to define a groove, each pair of metal strips being assembled with their tongues and grooves interengaged.

4. A heat exchanger as defined in claim 3 wherein the pair of plates defining each header structure are foldably hinged together and formed from a single blank.

5. A heat exchanger as defined in claim 4 wherein one of the aligned openings of each header structure is defined by a narrow flat marginal wall portion and the other aligned opening is defined by a perpendicularly disposed leg of an L-shaped marginal wall portion of a size and shape to enter the one opening of an adjacent header structure.

6. A heat exchanger as defined in claim 1 wherein the pair of plates, defining each header structure are foldably hinged together and formed from a single blank.

7. A heat exchanger as defined in claim 6 wherein one of the aligned openings of each header structure is defined by a narrow flat marginal wall portion and the other aligned opening is defined by a perpendicularly disposed leg of an L-shaped marginal wall portion of a size and shape to enter the one opening of an adjacent header structure.

8. A heat exchanger as defined in claim 1 wherein one of the aligned openings of each header structure is defined by a narrow flat marginal wall portion and the other aligned opening is defined by a perpendicularly disposed leg of an L-shaped marginal wall portion of a size and shape to enter the one opening of an adjacent header structure.

9. A heat exchanger suitable for automotive vehicle use comprising means defining a multiplicity of longitudinally extending flattened tube structures disposed in a longitudinally coextensive array with fins between adjacent pairs of tube structures, said tube structures having a longitudinally extent greater than said fins and being arranged so that opposite first and second end portions extend longitudinally outwardly in opposite directions from the fins, first and second header assemblies connected with the first and second end portions respectively of each tube structure and providing fluid inlet means for receiving first fluid means for passage through said tube structures during the passage of second fluid means through said fins and fluid outlet means for delivering the first fluid means after it has passed through said tube structures, each header assembly being formed of a series of interconnected header structures, the series of header structures of each assembly including an individual header structure associated with each tube structure end portion comprising a pair of sheet metal plates devoid of copper formed to provide first marginal edge portions sealingly fixed in abutting relation with the exterior periphery of the associated tube structure end portion, said fluid inlet means and said fluid outlet means being associated with certain of said individual header structures, the remainder of said individual header structures being constructed such that the pair of sheet metal plates comprising the same are also formed to provide wall portions spaced in a direction perpendicular to the longitudinal direction of extent of said tube structures and having aligned openings therein and remaining second marginal edge portions sealingly fixed by brazing in abutting engagement which together with said first marginal edge portions surround said openings and define with said spaced portions an enclosed first fluid means containing volume communicating the interior of the associated tube structure end portion with said openings, each spaced portion of each pair of sheet metal plates being sealingly fixed by brazing to a spaced portion of an adjacent pair of sheet metal plates along peripheries defining the openings therein whereby the heat exchanger can be inexpensively fitted to the specific automotive use.

10. A heat exchanger as defined in claim 9 wherein the pair of plates defining each header structure are foldably hinged together and formed from a single blank.

11. A heat exchanger as defined in claim 10 wherein one of the aligned openings of each header structure is defined by a narrow flat marginal wall portion and the other aligned opening is defined by a perpendicularly disposed leg of an L-shaped marginal wall portion of a size and shape to enter the one opening of an adjacent header structure.

12. A heat exchanger as defined in claim 9 wherein one of the aligned openings of each header structure is defined by a narrow flat marginal wall portion and the other aligned opening is defined by a perpendicularly disposed leg of an L-shaped marginal wall portion of a size and shape to enter the one opening of an adjacent header structure.

* * * * *